US005911252A

United States Patent [19]

Cassel

[11] Patent Number: 5,911,252

[45] Date of Patent: Jun. 15, 1999

[54] AUTOMATED SYRINGE FILLING SYSTEM FOR RADIOGRAPHIC CONTRAST AGENTS AND OTHER INJECTABLE SUBSTANCES

[76] Inventor: Douglas Cassel, 1766 Port Manleigh Cir., Newport Beach, Calif. 92660-6622

[21] Appl. No.: 08/845,812

[22] Filed: Apr. 29, 1997

[51] Int. Cl.[6] ..... B65B 1/04

[52] U.S. Cl. ..... 141/234; 141/27; 604/407

[58] Field of Search ..... 141/9, 21, 25, 141/26, 27, 99, 100, 102, 104, 105, 234, 247; 604/407

[56] References Cited

U.S. PATENT DOCUMENTS

| | | | |
|---|---|---|---|
| 3,734,147 | 5/1973 | Borutta et al. | 141/27 |
| 3,935,883 | 2/1976 | Stach et al. | 141/27 |
| 4,133,314 | 1/1979 | Bloom et al. | 128/272.3 |
| 4,187,890 | 2/1980 | Stach et al. | 141/27 |
| 4,253,501 | 3/1981 | Ogle | 141/27 |
| 4,433,974 | 2/1984 | Bischof | 604/407 |
| 4,883,101 | 11/1989 | Strong | 141/27 |
| 4,998,570 | 3/1991 | Strong | 141/27 |
| 5,220,948 | 6/1993 | Haber et al. | 141/27 |
| 5,329,974 | 7/1994 | Paping | 141/11 |
| 5,341,854 | 8/1994 | Zezulka et al. | 141/1 |
| 5,450,847 | 9/1995 | Kampfe et al. | 128/653.4 |
| 5,592,940 | 1/1997 | Kampfe et al. | 128/654 |
| 5,647,409 | 7/1997 | Christ et al. | 141/27 |

*Primary Examiner*—J. Casimer Jacyna
*Assistant Examiner*—Steven O. Douglas
*Attorney, Agent, or Firm*—Sereboff & Buyan, LLP

[57] ABSTRACT

A system and method for automated filling of one or more medical syringes with desired volume(s) and concentration(s) of an injectate solution, such as a contrast solution usable for medical imaging procedures (e.g., x-ray, MRI, ultrasound). The system may incorporate an automated syringe magazine which interfaces with the programmable system controller to deliver the desired number of syringes after the syringes have been filled. Also, the system may utilize a low-pressure pumping arrangement wherein a pumping device engages each receiving syringe and withdraws the plunger of the receiving syringe to pull the desired injectate solution into the receiving syringe by negative pressure.

22 Claims, 6 Drawing Sheets

AUTOMATED SYRINGE FILLING SYSTEM FOR RADIOGRAPHIC CONTRAST AGENTS AND OTHER INJECTABLE SUBSTANCES

FIELD OF THE INVENTION

The present invention relates generally to medical methods and devices, and more particularly to automated systems for filling medical syringes with injectate (e.g., radiographic contrast solution) of varying volume and/or varying concentration.

BACKGROUND OF THE INVENTION

In modern medical practice, it is sometimes desirable to pre-fill a number of syringes with an injectate (e.g, an injectable liquid), such that each syringe contains a predetermined volume and/or concentration of the injectate. Additionally, it is generally desirable to accomplish such filling of the syringes with little or no manual handling of the syringes, thereby freeing the hands of the physician for other tasks and/or minimizing the number of technicians or assistants who must be present in order to carry out the medical procedure.

In particular, various diagnostic imaging procedures (e.g., x-ray, nuclear magnetic resonance (NMR), ultrasound, etc.) require multiple injections of contrast solution to permit visualization of blood vessels or other anatomical structures by radiographic or other (e.g., magnetic, ultrasonic) imaging means. Such injections of contrast solution are typically carried out by pre-filling one or more syringes with radiographic contrast solution at the desired concentration(s) and volume(s). Thereafter, the pre-filled syringe(s) are utilized to deliver bolus injection(s) of contrast solution, during the radiological procedure.

It has been common practice to place a fresh vial or container of the desired contrast solution in the room wherein the imaging procedure is to be performed, along with one or more vials or bottles of diluent (e.g., 0.9% NaCl solution). Depending on the desired concentration of contrast solution to be injected and the number of such injections to be given, the physician or technician then proceeds to prefill one or more of the syringes by manually aspirating, into each syringe, i) a predetermined amount of the contrast solution from the first vial or bottle, and ii) a predetermined amount of the diluent from the second vial or bottle. In this manner, there are provided one or more prefilled syringe(s) which contain the desired volume(s) and concentration(s) of the contrast solution. However, such manual pre-filling of the syringes requires a substantial amount of handling and, in some procedures, may result in the need for an additional technician to be present in the procedure room to assist the physician in performing the procedure. Furthermore, such manual prefilling of syringes may be prone to human error, especially when various different dilutions or volume(s) of the contrast solution are being employed.

Additionally, once the fresh vial or bottle of contrast solution has been utilized at the patient's bed side, the infection control policies and practices of many healthcare institutions require that any left over contrast solution contained in that vial or bottle be discarded, rather than reusing the left-over solution in another procedure room for another patient. This can result in substantial waste of radiographic contrast solution, and may increase the expense of each imaging procedure performed.

The prior art has included various syringe filling devices and related apparatus which may be used to pre-fill medical syringes with injectate solutions. Examples of such syringe filling devices and/or related apparatus are found in U.S. Pat. Nos. 4,133,314 (Bloom et al.), 4,187,890 (Stach et al.), 4,253,501 (Ogle), 4,883,101 (Strong), 4,998,570 (Strong), 5,220,948 (Haber et al.), 5,329,974 (Paping), 5,341,854 (Zezulka et al.), 3,734,147 (Borutta et al.), 3,935,883 (Stach et al.), 5,450,847 (Kampfe et al.) and 5,592,940 (Kampfe et al.).

In particular, U.S. Pat. Nos. 5,450,847 (Kampfe et al.) and 5,592,940 (Kampfe et al.) describe an apparatus which is purportedly useable for mixing radiographic contrast solutions of varying concentration. The mixing apparatus described in U.S. Pat. Nos. 5,450,847 (Kampfe et al.) and 5,592,940 (Kampfe et al.) generally comprises; i.) a first tube or "pipe" connected to a container of concentrated radiographic contrast solution, ii.) a second tube or "pipe" connected to a container of diluent, iii.) a mixing chamber connected to the first and second pipes such that contrast solution and diluent from the respective containers may be received within the mixing chamber, and iv.) a delivery pipe which extends from the mixing chamber and terminates in an outlet to which a variety of receiving vessels (e.g., vials, bags or syringes) may be attached. Also, v.) metering apparatus are positioned on the first and second pipes to control the relative amounts of contrast solution and diluent which flow into the mixing chamber. Either gravity feed or pumps are used to feed the radiographic contrast solution and diluent through the respective first and second pipes and into the mixing chamber, wherein the resultant admixture of contrast solution/diluent is formed.

Notably, U.S. Pat. Nos. 5,450,847 (Kampfe et al.) and 5,592,940 (Kampfe et al.) do not describe or suggest the addition of a separate pump on the delivery pipe for controlling the passage of the admixture from the mixing chamber to the receiving vessel (e.g., bag, vial or syringe) connected to the outlet of the delivery pipe. Thus, the admixture which collects in the mixing chamber must be carried by gravity, or by the residual force of a pressure head created by any pumping devices located on the first and second pipes, into the final receiving vessel (e.g., bag, vial or syringe). Moreover, U.S. Pat. Nos. 5,540,847 (Kampfe et al.) and 5,592,940 (Kampfe et al.) do not describe or suggest the addition of any device for serially and/or automatically filling a number of individual syringes with the contrast solution/diluent admixture which flows out of the end of the delivery pipe.

Indeed, the apparatus described in U.S. Pat. Nos. 5,540,847 (Kampfe et al.) and 5,592,940 (Kampfe et al.) may be difficult or impossible to use for automated filling of multiple syringes without the need for manual connection and disconnection of each syringe to the outlet end of the delivery pipe, and/or manual pulling of the syringe plungers to facilitate the filling of such syringes.

In view of the above-mentioned shortcomings of the prior art, and others, there remains a need for the development of an improved apparatus for automated filling of numerous syringes, with equal or differing concentrations of radiographic contrast solution, so as to improve the efficiency and lessen the cost of radiological procedures wherein multiple injections of contrast solution are utilized.

SUMMARY OF THE INVENTION

The present invention provides a system for filling individual syringes with predetermined volume(s) and concentration(s) of an injectate solution. The basic system of the present invention comprises the following combination of elements: a) a syringe filling device comprising: i) at least one solution container containing a solution at a first concentration; ii) at least one diluent container containing a diluent which is suitable for diluting said solution; iii) a mixing apparatus fluidly connected to said solution container and said diluent container, said mixing apparatus being operative to combine a predetermined amount of said solution with a predetermined amount of said diluent to form an injectate solution of a predetermined volume and concentration; iv) an injectate delivery conduit attached to said mixing apparatus, for delivering said injectate solution of said predetermined volume and concentration; v) flow directing apparatus fluidly connected to said injectate delivery conduit, and to a plurality of individual syringe delivery tubes, said flow directing apparatus being operative to alternately channel the flow of injectate solution received through said delivery conduit, to a single one of said syringe delivery tubes; b) a syringe-handling magazine comprising a housing having a plurality of syringes mounted thereon, each of said syringes being connected to a selected one of said syringe delivery tubes, said magazine having apparatus for dispensing each syringe after such syringe has been filled with a predetermined volume and concentration of said injectate solution; c) pumping apparatus for propelling said solution and said diluent from said solution and diluent containers, through said mixing apparatus, through said injectate delivery conduit, through said flow directing means, and through said syringe delivery tubes and into said syringes; and, d) a programmable controller in communication with said mixing apparatus, said flow directing apparatus, said pumping apparatus and said syringe delivery magazine, said controller being adapted to receive operator input of the number of syringes to be filled, the predetermined volume of injectate solution to be dispensed into each syringe, and the predetermined concentration of injectate solution to be dispensed into each syringe, said controller being further operative to emit control signals to said mixing apparatus, said pumping apparatus, said flow directing apparatus and said syringe handling magazine to cause a desired number of syringes to be filled with the desired volume(s) and concentration(s) of injectate solution, as previously input by the operator. In some embodiments, the above-summarized system wherein the "pumping apparatus" poses a positive displacement pump positioned between the injectate delivery conduit and the flow directing apparatus, so as to pump the injectate solution under positive pressure into each of the syringes. In other embodiments, the above-summarized system may be a "low pressure" system wherein the pumping apparatus will comprise a syringe pump or similar device associated with the syringe-handling magazine to grasp and withdraw the plunger portion of each receiving syringe so as to aspirate or draw the injectate solution, through the system, and into that particular receiving syringe. These "low pressure" embodiments of the system may offer substantial advantages in that they operate under lower internal pressure than the above-mentioned "high pressure" embodiments, thereby eliminating the need for the use of high pressure tubings, high pressure fittings, and the like.

Various types of contrast agents may be used with the method and device of the present invention, depending on the type of diagnostic imaging procedure (e.g., x-ray, NMR, ultrasound, etc.) to be performed.

Contrast media useable in radiographic (i.e., x-ray) imaging procedures may contain, e.g., iotrolan, iopromide, iohexol, iosimide, metrixamide, salts of amidoacetic acid, iotroxic acid, iopamidol, 5-hydroxy-acciamido-2,4,6-triiodoisophthalic acid-(2,3-dihydroxy-N-methylpropyl)-(2-hydroxyethyl)-diamide, 3-carbomoyl-5-[N-(2-hydroxyethyl)-acetamido]-2,4,6-triiodobenzoic acid [(1RS,2SR)-2,3-dihydroxy-1-hydroxymethylpropyl]-amide and dispersions or suspensions of slightly soluble X-ray contrast agents such as iodipamide ethyl ester.

Contrast media useable for magnetic resonance imaging (i.e., NMR) include, gadolinium DTPA, gadolinium DOTA, gadolinium complex of 10[1-hydroxym ethyl-2,3-dihydroxypropyl]-1,4,7-tris-[(carboxymethyl)-1,4,7,10-tetraaracyclodecane], iron or manganese porphyrin chelates, and stable dispersions of magnetite.

Contrast media useable for ultrasound imaging include, e.g., dispersions of galactose microparticles with or without additives, galactose solutions, and dispersions of microspheres (e.g., cyano acrylates or albumin microspheres) or air bubbles, as well as other injectable microparticles.

Further in accordance with the invention, there are provided methods for performing radiologic procedures wherein multiple syringes are utilized to deliver multiple injections of radiographic contrast solutions at varying concentration(s) and/or volume(s), by utilizing the above-summarized syringe filling system to effect automated filling of the desired number of the desired number of syringes with desired concentration(s) and volume(s) of radiographic contrast solution.

Additional objects and advantages of the present invention will become apparent to those skilled in the art upon reading and understanding the following detailed descriptions of preferred embodiments and the accompanying drawings.

DETAILED DESCRIPTION OF THE PREFERRED EMBODIMENTS

The following detailed description and the accompanying drawings are provided for the purpose of describing and illustrating presently preferred embodiments of the invention only, and are not intended to limit the scope of the invention in any way.

a. First Embodiment

Figure 1:
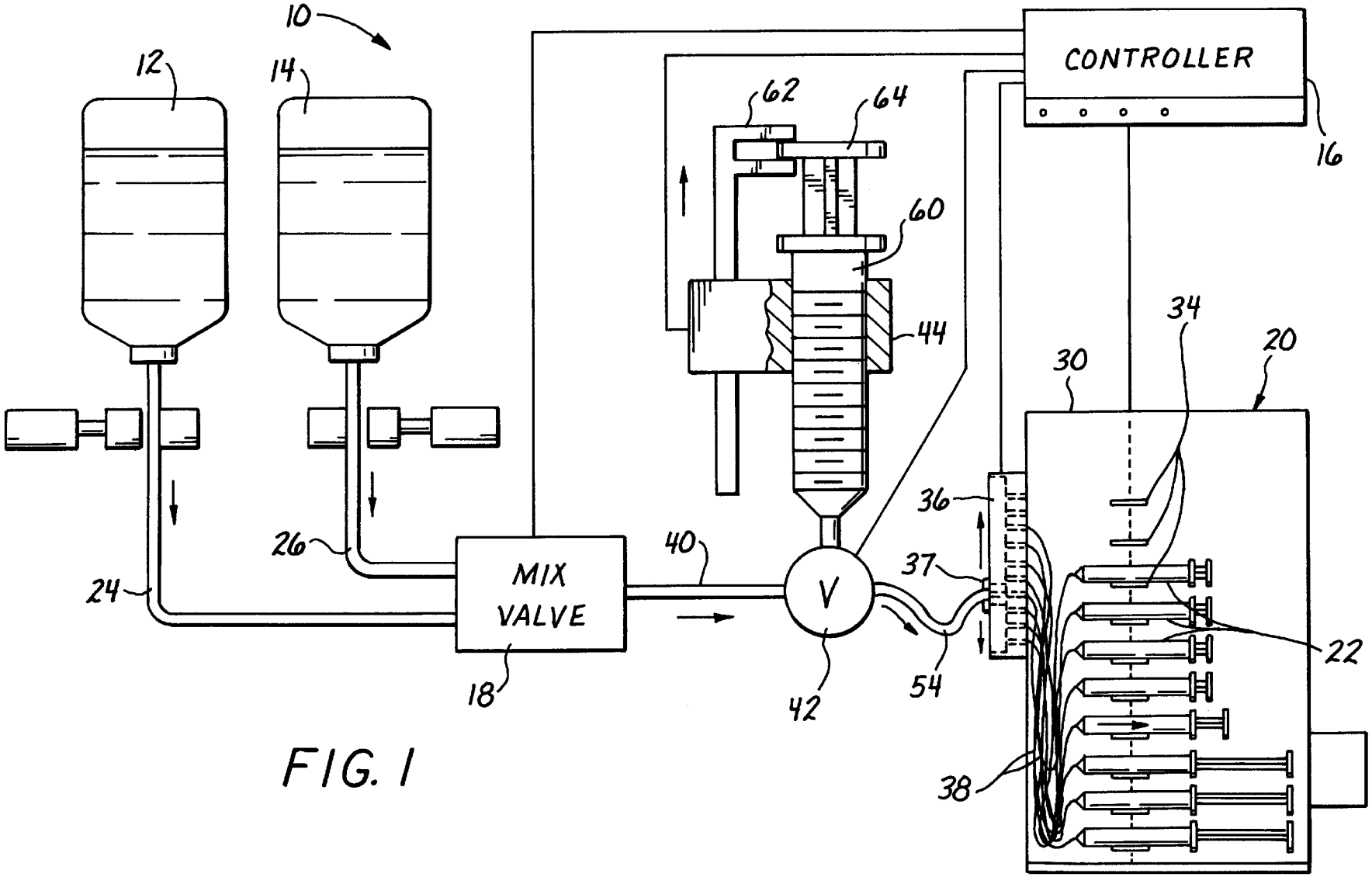
FIG. 1 is a schematic showing of a high pressure variant of a first embodiment of an automated syringe filling system of the present invention.
Figure 1A:
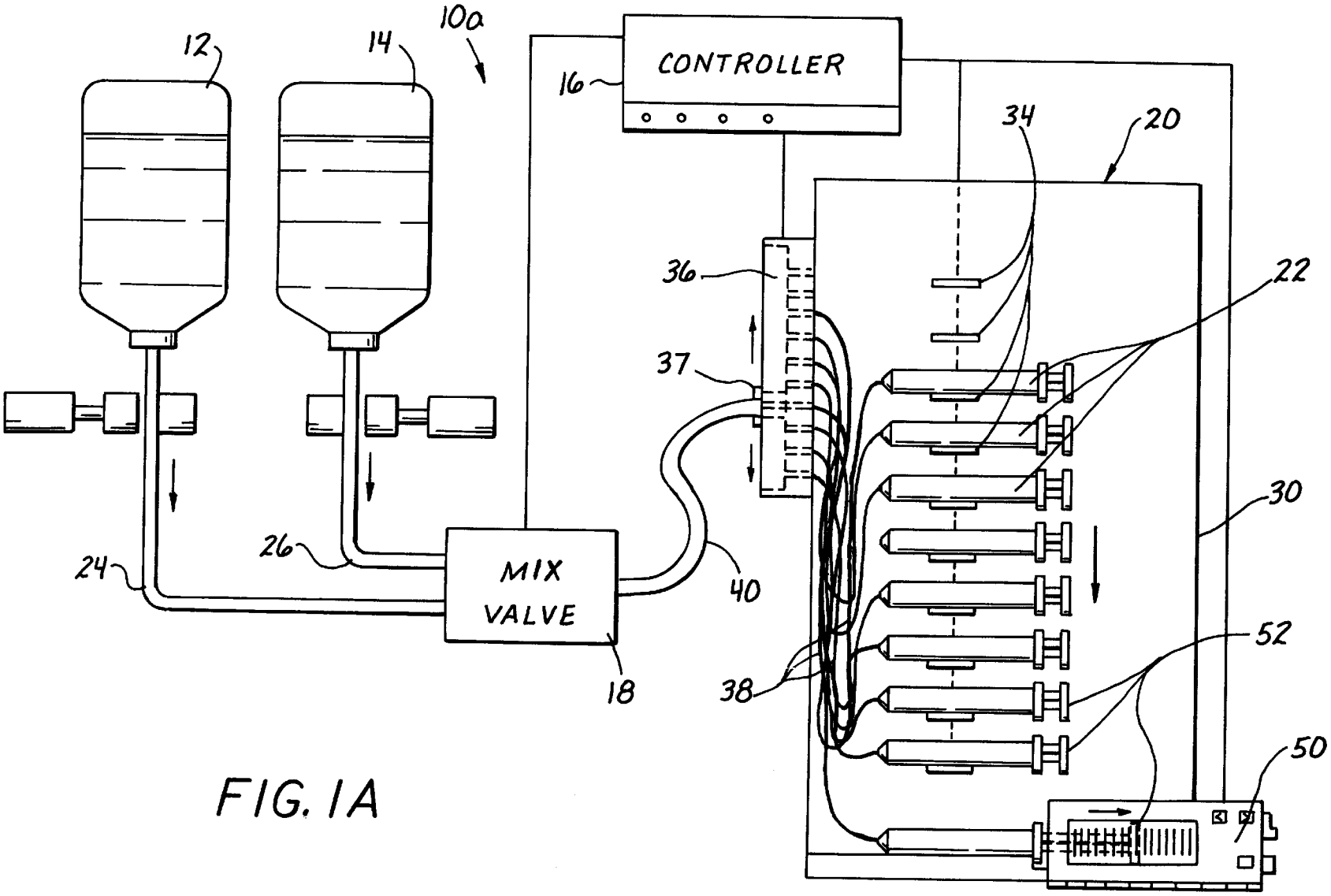
FIG. 1*a* is a schematic showing of a low pressure variant of the first embodiment of the automatic syringe filling system shown in FIG. 1.

FIGS. 1–1*a* show a first embodiment of a system 10, 10*a* of the present invention. The system 10 shown in FIG. 1 is a high pressure system, while the system 10*a* shown in FIG. 1*a* is a low pressure system. The systems 10, 10*a* shown in FIGS. 1 & 1*a* share numerous common elements, including a first container 12 containing concentrated radiographic contrast solution, a second container 14 containing diluent (e.g., saline solution), a microprocessor controller 16, a mixing valve 18 and a syringe magazine 20 having a plurality of syringes 22 loaded therewith. In both the high pressure system 10 and the low pressure system 10*a*, the first and second containers 12, 14 are connected to the mixing valve 18 by way of first and second tubes 24, 26, respectively.

The syringe magazine 20 comprises a housing 30 having a series of retractable syringe holding members 34 (e.g., shelves) formed at spaced apart locations in vertical alignment within the interior of the housing 30. Each individual syringe 22 is initially mounted on one of the syringe support members 34 such that the syringes 22 are held in spaced apart vertical alignment within the housing 20, as shown.

A multiple outlet manifold 36 is mounted on the housing and each syringe 22 is connected to a separate outlet of the manifold 36 by disposable tubing 38.

In the high pressure embodiment of the system 10*a* shown in FIG. 1, the mixing valve 18 is connected by way of a delivery tube 40 to a three way valve 42. A syringe pump 44 is connected to one of the outlets of the three way valve 42 while a secondary delivery tube 54 connected at one end to the other outlet of the three way valve 42, and at the other end to the removable inlet fitting 37 of the multiple outlet manifold 36.

In the low pressure embodiment system 10*a* shown in FIG. 1*a*, the delivery tube 40 which leads from the outport of the mixing valve 18 is connected directly to the moveable inlet fitting 34 of the multiple outlet manifold 36, and a syringe pump 50 is mounted within or immediately beneath the base of the syringe magazine 20 such that the individual receiving syringes 22 held within the magazine housing 30 may be individually dropped, fed or otherwise advanced into engagement with the syringe pump 50 such that the syringe pump may withdraw the plunger 52 of each syringe 22 while that syringe 22 is in engagement with the syringe pump 50.

i. A High Pressure Version of The First Embodiment (FIG. 1)

In the high pressure system 10 shown in FIG. 1, the microprocessor controller 16 is connected to or otherwise in communication with the mixing valve 18, syringe pump 44, three way valve 42, multiple outlet manifold 36, and retractable syringe support members 34. The controller 16 incorporates one or more dials, key pads, settable knobs or other input apparatus which may be utilized by the operator to input, into the controller, the desired a) concentration, and b) volume of injectate to be loaded into each of the receiving syringes 22. Additionally, the controller 16 will incorporate an actuation switch which may be triggered by the operator desires for the system to deliver injectate of the previously-input concentration and volume, into one or more of the receiving syringes 22. Upon actuation, the controller 16 will provide time-coordinated control signals to the mixing valve 18, syringe pump 44, three way valve 42, multiple outlet manifold 36 and retractable syringe support members 34 such that, to accomplish filling of each individual receiving syringe 22, the following coordinated events will occur:

1. The mixing valve 18 will be set to meter and combine the concentrated solution from a first container 12 with the diluent from the second container 14 at a ratio which will provide the desired injectate concentration for that receiving syringe 22;
2. The three way valve 42 will be initially set in a first position such that the concentrate/diluent admixture flowing from the mixing valve through the delivery tube 40 will pass through the three way valve 42 and into the pumping syringe barrel 60 of the syringe pump 44;
3. The plunger withdrawal/advancement arm 62 of the syringe pump 44 will be caused to withdraw the plunger 64 of the pumping syringe by a sufficient amount to cause the desired volume of injectate to be drawn through the mixing valve 18, through the delivery tube 40 and into the barrel 60 of the pumping syringe;
4. The three way valve 42 will then be shifted to a second setting whereby fluid contained within the barrel 60 of the pumping syringe will pass through the three way valve 42 and into the secondary delivery tube 54;
5. The controller 16 will then cause the plunger withdrawal/advancement arm 62 of the delivery pump 44 to advance the plunger 64 of the pumping syringe so as to expel the injectate admixture which had been drawn into the barrel 60 of the pumping syringe, through the three way valve 42 and through the secondary delivery tube 54 into the multiple outlet manifold 36;
6. The controller will also move the moveable inlet fitting 34 of the multiple outlet manifold 36 into alignment with the outlet port 39 of the manifold 36 which is connected by one of the tube 38 to the receiving syringe 22 which is intended to receive the quantity of injectate being expelled at that time by the syringe pump 44. In this manner, the desired volume of injectate, at the desired concentration, will be pumped through the manifold 36, through the respective one of the tubes 38 and into the intended receiving syringe 22. The force with which the syringe pump 44 will deliver such injectate will be sufficient to cause the plunger of the receiving syringe 22 to be forced back such that the intended volume of injectate will be dispensed into and received within the barrel of that receiving syringe 22;
7. The controller will then trigger the syringe support member 34 which supports the individual receiving syringe 22 which has just been filled with injectate to retract, thereby allowing that receiving syringe 22 to fall out of the bottom of the magazine 20 such that it may be retrieved, and disconnected from its disposable tube 38 by the operator.
8. The above-listed events will then be repeated, at the desired time intervals, for each of the receiving syringes 22, thereby dispensing into each receiving syringe 22 the specifically desired concentration and volume of the injectate.

ii. A Low Pressure Version of the First Embodiment (FIG. 1A)

With reference to FIG. 1*a*, after the operator has input into the controller 16 the desired injectate concentration and volume to be dispensed into each of the receiving syringes 22, and the desired number of syringes 22 to be filled, the operator will trigger the actuation switch of the controller such that the controller will emit control signals to cause the following events to occur:

1. The mixing valve will be set to combine the concentrate from the first container 12 and diluent from the second container 14 at a ratio which will produce an injectate admixture of the desired concentration for delivery into the intended receiving syringe 22;
2. The controller will cause the syringe support member 34 supporting the receiving syringe 22 to be filled to retract, thereby allowing that receiving syringe 22 to drop downwardly into engagement with the syringe pump 50 such that the plunger 52 of that receiving syringe 22 may be withdrawn by the syringe pump 50;

3. The controller will then cause the moveable inlet fitting 37 of the multiple outlet manifold 36 to move into alignment with the particular outlet opening to which the tube 38 for that particular receiving syringe 22 is connected;
4. The controller will then cause the syringe pump 50 to withdraw the plunger 52 of that particular receiving syringe 22 by a distance which will cause the desired volume of the injectate admixture to be drawn from the concentrate and diluent containers 12, 14, through the tubes 24, 26, through the mixing valve 18, through the delivery tube 40, through the manifold 36, through that feed tube 38 and into the barrel of that receiving syringe 22.
5. After each receiving syringe has been filled with the desired concentration and volume of injectate admixture,that receiving syringe 22 may then be volitionally removed from the syringe pump 50 by the operator or, alternatively, the syringe pump 50 may be triggered by the controller 16 to release that syringe 22 such that syringe will fall downwardly, thereby leaving the syringe pump 50 open and able to receive the next receiving syringe 22.

B. Second Embodiment

Figure 2:
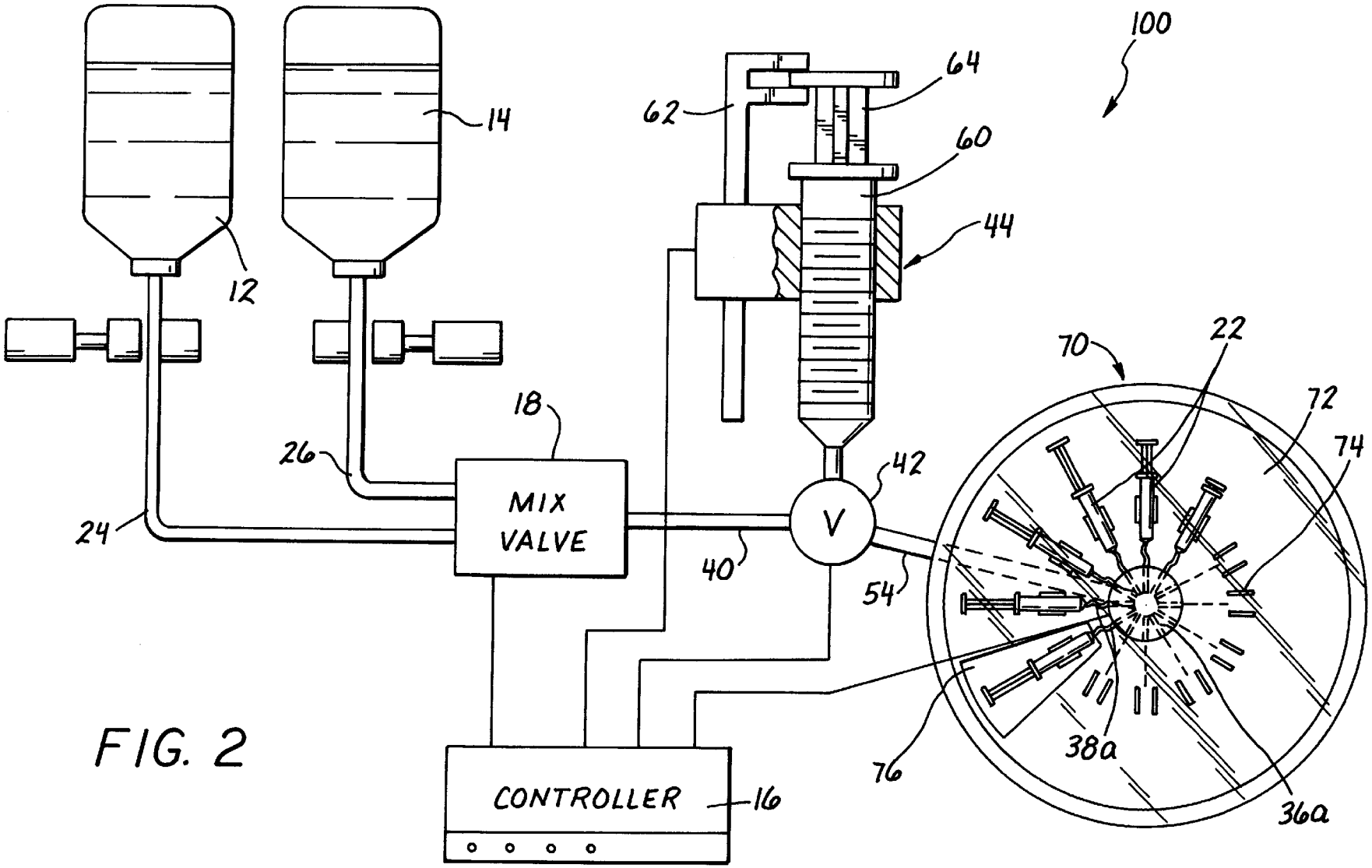
FIG. 2 is a schematic showing of a high pressure variant of a second embodiment of an automated syringe filling system of the present invention.
Figure 2A:
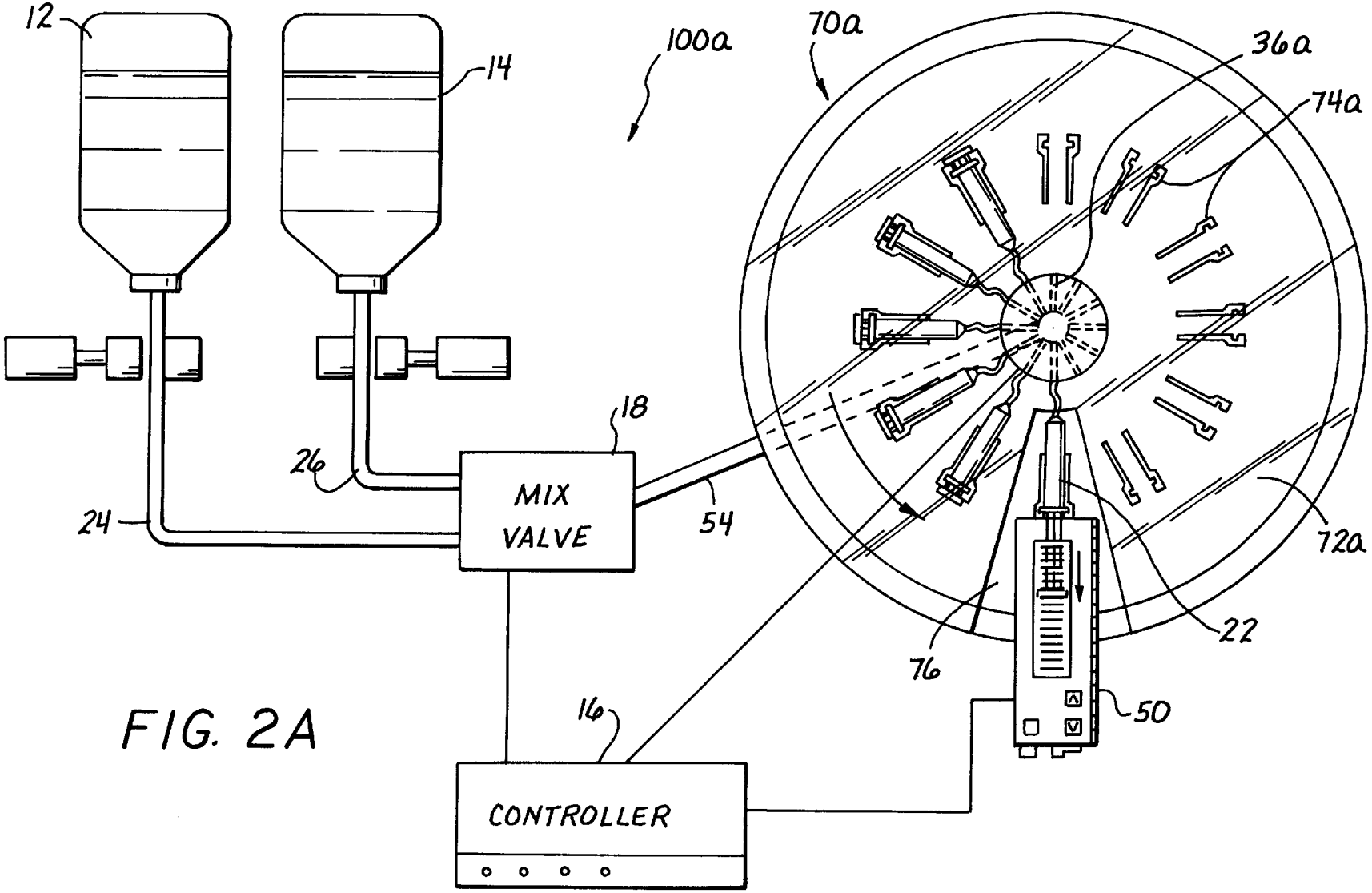
FIG. 2*a* is a schematic showing of a low pressure variant of the second embodiment of the automated syringe filling system shown in FIG. 2.

A second embodiment of the present invention is shown in FIGS. 2 and 2*a*. FIG. 2 shows a high pressure syringe filling system 100 and FIG. 2*a* shows a low pressure version of such syringe filling system 100*a*.

The high pressure and low pressure variance of the second embodiment of the system 100, 100a incorporate, in common with the above-described first embodiments, a first reservoir 12 containing concentrated solution, a second reservoir 14 containing diluent (e.g., saline solution), a mixing valve 18, and a microprocessor controller 16 of the type described hereabove with respect to the first embodiments. However, in the second embodiments of the system 100, 100*a*, the individual receiving syringes 22 are located into a turntable-type syringe handling apparatus 70, rather than be vertically loaded syringe magazine 20 described hereabove with respect to the first embodiments.

The turntable tight syringe handling apparatus 70 comprises a turntable 72 having a plurality of syringe holding clips 74 formed thereon. The individual receiving syringes 20 are inserted into the syringe holding clip 74 such that each receiving syringe 22 is held at a desired location on the turntable 72. An annular outlet manifold 36*a* is formed in the center of the turntable 42 and is connected to a central fluid delivery hub (not shown) such that as the turntable 72 is rotated, each outlet port of the annular multiple outlet manifold 36 will be sequentially brought into alignment with-an outlet opening formed on the fluid delivery hub (not shown) such that the desired injectate admixture may be delivered from the fluid delivery hub (not shown), through a single outlet opening in the multiple outlet manifold 36*a*. Disposable tubes 38*a* connect each receiving syringe 22 to a respective outlet port on the multiple outlet manifold 36*a*. The turntable 72 is connected to or otherwise in communication with the controller 16 such that the controller may cause the turntable to rotate incrementally such that the manifold outlet port leading through each tube 38*a* to each receiving syringe 22 will be sequentially brought into alignment with the outlet opening of the central hub (not shown) so as to deliver the desired injectate admixture into that receiving syringe 22. Optionally, a dome or covering may be formed on the turntable type syringe handling apparatus 70, with an opening 76 formed therein to permit the operator to manually retrieve that receiving syringe 20 after it has been filled with the desired concentration and volume of the injectate admixture.

i. A High Pressure Version of the Second Embodiment (FIG. 2)

In operation, the high pressure variant of the second embodiment of the automated syringe filling system 100 shown in FIG. 2 requires that, after the desired injectate concentrations, injectate volumes, and number of syringes to be filled has been input into the controller 16, the operator will then actuate the controller such that the controller will issue control signals to the mixing valve 18, syringe pump 44, three way valve 42 and turn table type syringe handling apparatus 70 so as to accomplish filling of each individual receiving syringe 22 by the following series of events:

1. The controller 16 will initially set the mixing valve 18 to meter and combine the flow of concentrate received through the first tube 24 with the flow of diluent received through the second tube 24 at a desired ratio, so as to pass the injectate admixture of the desired concentration into the primary delivery tube 40;
2. The controller will cause the three way valve 42 to initially be set in a first position whereby the injectate admixture passing from the mixing valve 18 through the primary delivery tube 40 will pass through the three way valve 42 and into the barrel 60 of the pumping syringe of the syringe pump 44;
3. The controller will signal the plunger withdrawing/advancing arm 62 of the syringe pump 44 to then move by a predetermined amount to withdraw the plunger 64 of the pumping syringe by a distance which will cause the desired volume of the injectate admixture to be drawn into the barrel 60 of the pumping syringe;
4. Thereafter the controller 16 will cause the three way valve 42 to shift to a second position whereby the injectate admixture which has been drawn into the barrel 60 of the pumping barrel 60 of the pumping syringe will pass through the three way valve 42 and into the secondary delivery tube 44 which leads to the fluid delivery hub (not shown) of the turn table type syringe handling apparatus 70;
5. The controller 16 will then cause the turntable 72 to advance to a position wherein the intended receiving syringe 22 and the particular outlet port of the multiple outlet manifold 36 to which that syringe 22 is connected will be in alignment with the outlet opening of the central fluid delivery hub (not shown);
6. Thereafter the controller will cause the plunger withdrawal/advancement arm 62 of the syringe pump to advance so as to fully expel the previously withdrawn volume of injectate admixture from the barrel 60 of the pumping syringe, through the three way valve 42 through the secondary delivery tube 54 through the central fluid delivery hub (not shown), through the intended delivery port of the multiple outlet manifold 36*a*, through the intended disposable tube 38*a* and into the intended receiving syringe 22.

After that receiving syringe 22 has been filled with the intended volume and concentration in injectate admixture, the operator may manually remove that receiving syringe 22 from its syringe holding clip 74 and may detach that receiving syringe 22 from its disposable tube 38*a* so that the syringe 22 may be utilized for injection of contrast medium during the medical procedure.

ii. A Low Pressure Version of the Second Embodiment (FIG. 2*a*)

With reference to FIG. 2*a*, the low pressure variant of the automated syringe filling system 100*a* differs from the high pressure embodiment shown in FIG. 2 in that, instead of a syringe pump 44 for delivering the injectate admixture under high pressure into each of the receiving syringes 22, there is provided a receiving syringe pump 50 which independently engages each of the receiving syringes 22 and operates to withdraw the plunger of that receiving syringe 22 to withdraw the desired volume of the injectate admixture into that receiving syringe 22.

As shown in FIG. 2*a*, this low pressure variant of the second embodiment of the automated syringe filling system 100*a* utilizes a turn table type syringe handling apparatus 70*a* which differs from that shown in FIG. 2 in that the syringe holding clip 74*a* are configured to firmly engage a flange formed on each syringe 22 so as to prevent the syringe 22 from moving longitudinally as the syringe pump 50 is withdrawing the plunger of that syringe.

Additionally, the receiving syringe pump 50 is mounted at a specific position adjacent the turn table 72*a* such that, in response to control signals received from the controller 16, the turn table 72*a* will advance each of the receiving syringes 22 into contact with the syringe pump 50 such that a plunger-withdrawing member of the syringe pump 50 may withdraw the plunger of that receiving syringe 22 by the desired distance so as to withdraw into the barrel of that receiving syringe 22 by the desired distance so as to withdraw into the barrel of that receiving syringe 22 the desired volume of injectate admixture.

In this manner, the low pressure variant of the second embodiment of the second embodiment of the automated syringe filling system 100*a* shown in FIG. 2*a* will operate to fill each individual receiving syringe 22 by the following events:

1. The controller 16 will initially adjust the mixing valve 18 so that the mixing valve will combine the flow of concentrate received through the first tube 24 with the flow of diluent received through the second tube 26 at a ratio which will provide into the primary delivery tube 54 the injectate admixture of the previously-input concentration for that receiving syringe;
2. The controller 16 will then trigger the turn table 72*a* to advance to a position wherein the intended receiving syringe 22 is an engagement with the receiving pump 50;
3. The controller 16 will then cause the receiving syringe pump 50 to withdraw the plunger of that receiving syringe 22 by desired distance, thereby drawing the desired injectate admixture through the mixing valve 18, through the primary delivery tube 54, through the central fluid delivery hub (not shown) through the associated outlet port of the multiple outlet manifold 36*a*, through the disposable tube 38*a* attached to that receiving syringe 22 and into the barrel of that receiving syringe.

After each receiving syringe 22 has been filled with the desired concentration and volume of the injectate admixture, the operator may then manually detach that receiving syringe 22 from the receiving syringe pump 50 and from its associated disposable tube 38*a*, and will remove that syringe 22 through the opening 76 or otherwise. In this manner, the prefilled syringe 22 may then be utilized to inject the desired concentration and volume of radiographic contrast medium during the medical procedure.

C. Alternative Valving Arrangement for the First or Second Embodiment

Figure 3:
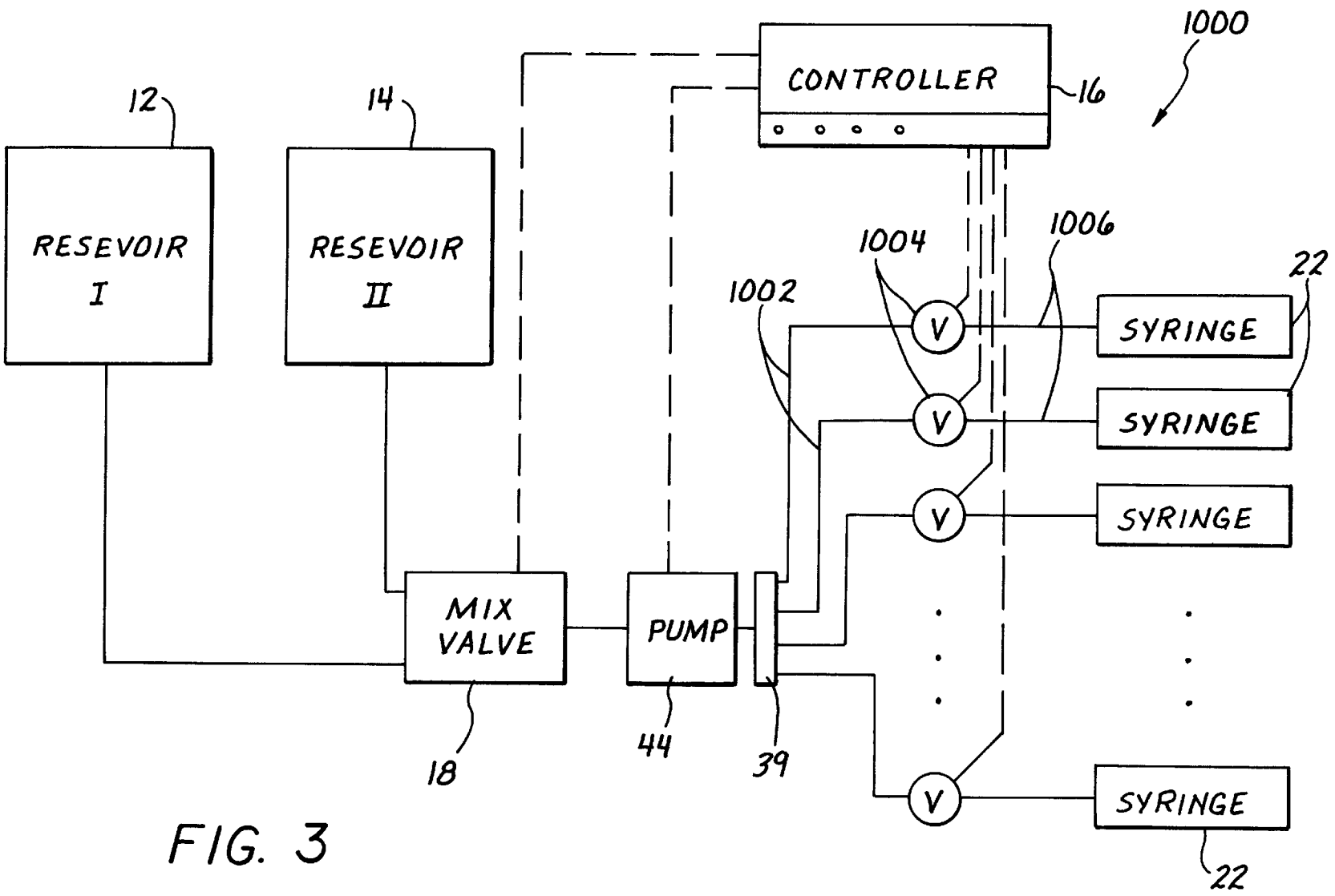
FIG. 3 is a schematic diagram of a modified manifold/valving arrangement which may be utilized in the high pressure or low pressure variants of the first embodiment shown in FIGS. 1 and 1*a*.
Figure 3A:
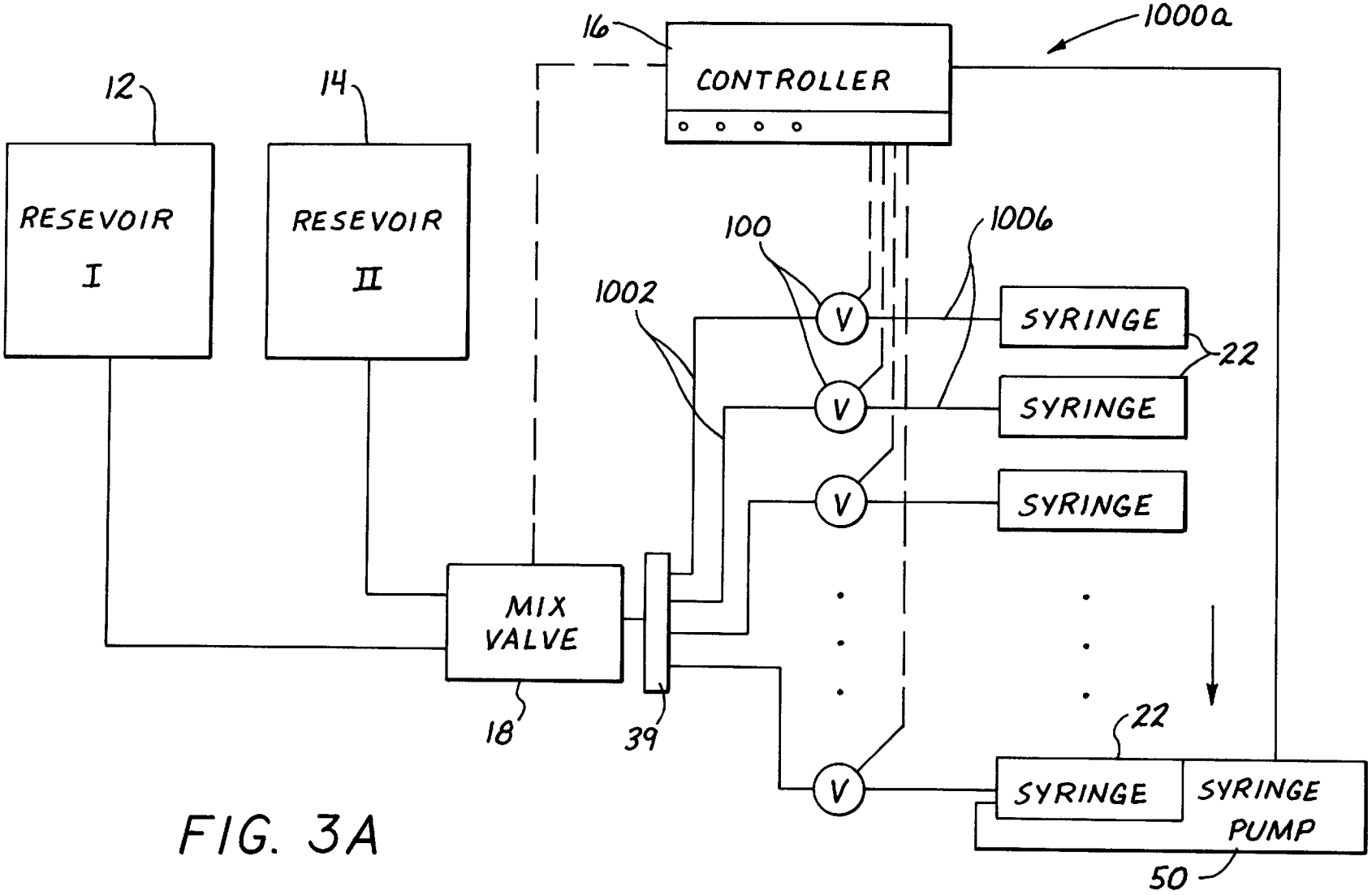
FIG. 3*a* is a schematic diagram of a modified manifold/valving arrangement which may be utilized in the high pressure or low pressure variants of the second embodiment shown in FIGS. 2 and 2*a*.

FIGS. 3 & 3*a* show, in schematic fashion, certain valving modifications which may be made to either the high pressure variants shown in FIGS. 1 and 2, or the low pressure variants shown in FIGS. 1*a* and 1*b*.

In particular, FIG. 3 shows a valving modification which may be made to the high pressure variant of the first embodiment of the automated syringe filling system 10 shown in FIG. 1, or the high pressure variant of the second embodiment of the automated syringe filling system 100 shown in FIG. 2.

Referring to FIG. 3, a fixed-inlet multiple outlet manifold 39 having a non-moveable inlet fitting is provided, such that injectate admixture delivered from the syringe pump 44 will be concurrently available to all outlet ports of the multiple outlet manifold 39. Each outlet port of the multiple outlet manifold 39 is connected, by disposable tubing 1002 to a respective controller-actuated valve 1004.

Each controller actuated valve 1004 is connected by way of a secondary disposable tube 1006 to one of the receiving syringes 22.

When the valving modification illustrated in FIG. 3 is incorporated into a high pressure embodiment of the invention, the controller 16 will sequentially cause a single one of the controller actuator valves 1004 to open when it is desired to fill the particular receiving syringe 22 connected to that controller-actuated receiving valve 1004. In this manner, pressurized injectate admixture delivered by the syringe pump 44 will enter the entire manifold but will be prevented from flowing through all but the open one of the valves 1004, thereby selectively filling the intended receiving syringe 22.

In the above-described manner, the controller 16 will independently open and close each of the controller actuated valves 1004, one at a time, to effect sequential filling of each of the receiving syringes 22.

FIG. 3*a* shows a similar valving modification which may be made to the low pressure variant of the first embodiment of the syringe filling system 10*a* shown in FIG. 1*a*, or to the low pressure variant of the second embodiment of the automated syringe filling system 100*a* shown in FIG. 2*a*.

With reference to FIG. 3*a*, a fixed-inlet, multiple-outlet manifold 39 is connected by tubes 1002 to a series of separate controller actuated valves 1004. The controller 16 will open only one controller actuated valve 1004 at a time so as to fill only the intended receiving syringe 22 located in the receiving syringe pump 50 at a time.

The present invention has been described hereabove with reference to certain presently preferred embodiments and examples only, and no effort has been made to exhaustively describe and show all possible variants and embodiments in which the invention may take physical form. Indeed, numerous changes or modifications may be made to any or all of the above-described variants and embodiments without departing from the intended spirit and scope of the invention, and it is intended that all such reasonable modifications or changes be included within the scope of the invention recited in the following claims.

What is claimed is:

1. A system for filling a desired number of receiving syringes with desired volume(s) and desired concentration(s) of an injectate solution, said system comprising:

a syringe filling device comprising:

i) at least one solution container containing a solution at a first concentration;

ii) at least one diluent container containing a diluent which is suitable for diluting said solution;

iii) a mixing apparatus fluidly connected to said solution container and said diluent container, said mixing apparatus being operative to combine a predetermined amount of said solution with a predetermined amount of said diluent to form an injectate solution of a predetermined volume and concentration;

iv) an injectate delivery conduit attached to said mixing apparatus, for delivering said injectate solution of said predetermined volume and concentration;

v) flow directing apparatus fluidly connected to said injectate delivery conduit, and to a plurality of individual syringe filling tubes, said flow directing apparatus being operative to alternately channel the flow of injectate solution received through said delivery conduit, to a single one of said syringe filling tubes;

a syringe-handling magazine adapted to receive and hold a plurality of syringes while each such syringe is connected to a selected one of said syringe filling tubes, said magazine being operative to deliver each syringe after such syringe has been filled with a predetermined volume and concentration of said injectate solution;

pumping apparatus for propelling said solution and said diluent from said solution and diluent containers, through said mixing apparatus, through said injectate delivery conduit, through said flow directing means, and through said syringe delivery tubes and into said syringes; and, a programmable controller in communication with said mixing apparatus, said flow directing apparatus, said pumping apparatus and said syringe delivery magazine;

said controller being capable of receiving operator input of the i) desired number of syringes to be filled, ii) the desired volume of injectate solution to be dispensed into each syringe, and iii) the desired concentration of injectate solution to be dispensed into each syringe;

said controller being further operative to send control signals to i) said mixing apparatus, ii) said pumping apparatus, iii) said flow directing apparatus, and iv) said syringe handling magazine, to cause the desired number of syringe(s) to be filled with the desired volume(s) and the desired concentration(s) of injectate solution as input by the operator.

2. The system of claim 1 wherein said pumping apparatus comprises a positive displacement pump positioned between said injectate delivery conduit and said flow directing apparatus such that said pumping apparatus will deliver said injectate solution under positive pressure which is sufficient to advance said injectate solution through said syringe delivery tube and into said syringes.

3. The system of claim 1 wherein said pumping apparatus is a syringe pump which alternately couples to and manipulates each receiving syringe to draw the injectate solution through at least said delivery conduit, and through the syringe delivery tube associated with that syringe, thereby filling each said syringe.

4. The system of claim 1 specifically adapted for use in filling a plurality of syringes with radiographic contrast solution of predetermined volume(s) and concentration(s), and wherein:

said at least one solution container contains a radiographic contrast solution at a first concentration.

5. The system of claim 1 wherein said mixing apparatus comprises an adjustable mixing valve having a first inlet connected to said solution container, a second inlet connected to said diluent container, an outlet connected to said injectate delivery conduit, and at least one adjustable flow regulator for regulating the ratio of solution and diluent which pass into said injectate delivery conduit.

6. The system of claim 1 wherein said flow directing apparatus comprises a manifold having an inlet port connected to said injectate delivery conduit, and a plurality of outlet ports connected to each of said syringe delivery tubes, said manifold further comprising a flow directing element which, in response to signals received from said programmable controller, will alternately channel the flow of injectate solution received through said injectate delivery conduit, to a selected one of said outlet ports and through a selected one of said syringe delivery tubes.

7. The system of claim 1 wherein said syringe-handling magazine comprises a housing having a plurality of syringe holding members formed therein so as to hold said syringes in a substantially linear array, each of said syringe holding members being individually moveable in response to signals received from said controller to thereby dispense each of said syringes after each said syringe has become filled with the predetermined volume an concentration of injectate solution.

8. The system of claim 1 wherein said syringe handling magazine comprises a turntable having a plurality of syringe holding stations formed thereon, each of said syringe holding stations being operative to hold a selected one of said syringes, said turntable being rotatable in response to control signals received from said controller, to deliver each of the syringes held by said syringe holding stations to a location whereat each such syringe may be removed by the operator.

9. The system of claim 8 wherein the flow directing apparatus comprises a stationary injectate delivery hub having an outlet port formed at a first location, and a rotatable annular receiving hub positioned about said delivery hub, said receiving hub having a plurality of receiving ports formed therein, each of said receiving ports of said receiving hub being connected to a receiving syringe positioned in each of said syringe holding stations, said receiving hub being rotatable in conjunction with said turntable to serially move each of the receiving ports of said receiving hub into alignment with the delivery port of said delivery hub such that injectate solution may flow into the receiving syringe connected to that receiving port.

10. A system for filling one or more receiving syringe(s) with desired volume(s) and desired concentration(s) of an injectate solution, said system comprising:

a syringe filling device comprising:

i) at least one solution container containing a solution at a first concentration;

ii) at least one diluent container containing a diluent which is suitable for diluting said solution;

iii) a mixing apparatus fluidly connected to said solution container and said diluent container, said mixing apparatus being operative to combine a predetermined amount of said solution with a predetermined amount of said diluent to form an injectate solution of a predetermined volume and concentration;

iv) an injectate delivery conduit attached to said mixing apparatus, for delivering said injectate solution of said predetermined volume and concentration;

v) a receiving syringe having a barrel and a plunger movably disposed within the barrel, said receiving syringe being connected to said injectate delivery conduit such that when the when the plunger of the syringe is withdrawn in a first direction, injectate will be thereby drawn through the delivery conduit and into the barrel of the receiving syringe;

vi) a syringe pump engageable with said receiving syringe and operative to withdraw the plunger of the receiving syringe to cause the desired volume of injectate solution to be drawn into the barrel of the receiving syringe;

a programmable controller in communication with at least said mixing apparatus, and said syringe pump;

said controller being capable of receiving operator input of i) the desired volume of injectate solution to be dispensed into each receiving syringe, and iii) the desired concentration of injectate solution to be dispensed into each receiving syringe;

said controller being further operative to send control signals to said mixing apparatus and said syringe pump to cause the syringe to be filled with the desired volume and the desired concentration of injectate solution.

11. The system of claim 10 wherein the syringe filling device further comprises:

vii) a flow directing apparatus connected to said injectate delivery conduit, said flow directing apparatus having a plurality of outlets formed therein and means for selectively channeling the flow of injectate from the injectate delivery conduit, out of a selected one of the outlet openings formed in said flow directing apparatus;

viii) a syringe handling magazine adapted to receive a plurality of said receiving syringes with each of said receiving syringes being connected to a selected one of the outlet openings of the flow directing apparatus, said magazine being operative to serially dispense a desired number of the syringes after they have been filled with the desired concentration and the desired volume of injectate;

and wherein said programmable controller is further in communication with said flow directing apparatus and said syringe handling magazine, said controller being further capable of receiving operator input of the desired number of receiving syringes in addition to the desired concentration and volume of injectate to be dispensed into each receiving syringe;

said controller being further operative to send control signals to said flow directing apparatus and said syringe magazine to fill the desired number of syringes with the desired volume and concentration of injectate, and to dispense said desired number of syringes to the operator.

12. The system of claim 11 wherein said flow directing apparatus comprises a manifold having an inlet port connected to said injectate delivery conduit, and a plurality of outlet ports connected to each of said syringe delivery tubes, said manifold further comprising a flow directing element which, in response to signals received from said programmable controller, will alternately channel the flow of injectate solution received through said injectate delivery conduit, to a selected one of said outlet ports and through a selected one of said syringe deliver tubes.

13. The system of claim 11 wherein said syringe-handling magazine comprises a housing having a plurality of syringe holding members formed therein so as to hold said syringes in a substantially linear array, each of said syringe holding members being individually moveable in response to signals received from said controller to thereby dispense each of said syringes after each said syringe has become filled with the predetermined volume an concentration of injectate solution.

14. The system of claim 11 wherein said syringe handling magazine comprises a turntable having a plurality of syringe holding stations formed thereon, each of said syringe holding stations being operative to hold a selected one of said syringes, said turntable being rotatable in response to control signals received from said controller, to deliver each of the syringes held by said syringe holding stations to a location whereat each such syringe may be removed by the operator.

15. The system of claim 14 wherein the flow directing apparatus comprises a stationary injectate delivery hub having an outlet port formed at a first location, and a rotatable annular receiving hub positioned about said delivery hub, said receiving hub having a plurality of receiving ports formed therein, each of said receiving ports of said receiving hub being connected to a receiving syringe positioned in each of said syringe holding stations, said receiving hub being rotatable in conjunction with said turntable to serially move each of the receiving ports of said receiving hub into alignment with the delivery port of said delivery hub such that injectate solution may flow into the receiving syringe connected to that receiving port.

16. The system of claim 10 specifically adapted for use in filling said syringe with radiographic contrast solution of predetermined volume and concentration, and wherein:

said at least one solution container contains a radiographic contrast solution at a first concentration.

17. The system of claim 10 wherein said mixing apparatus comprises an adjustable mixing valve having a first inlet connected to said solution container, a second inlet connected to said diluent container, an outlet connected to said injectate delivery conduit, and at least one adjustable flow regulator for regulating the ratio of solution and diluent which pass into said injectate delivery conduit.

18. A method for filling a desired number of receiving syringes with desired volume(s) and desired concentration(s) of an injectate solution, said method comprising:

a) providing a syringe filling device which comprises:

i) at least one solution container containing a solution at a first concentration;

ii) at least one diluent container containing a diluent which is suitable for diluting said solution;

iii) a mixing apparatus fluidly connected to said solution container and said diluent container, said mixing apparatus being operative to combine a predetermined amount of said solution with a predetermined amount of said diluent to form an injectate solution of a predetermined volume and concentration;

iv) an injectate delivery conduit attached to said mixing apparatus, for delivering said injectate solution of said predetermined volume and concentration;

v) flow directing apparatus fluidly connected to said injectate delivery conduit, and to a plurality of individual syringe filling tubes, said flow directing apparatus being operative to alternately channel the flow of injectate solution received through said delivery conduit, to a single one of said syringe filling tubes;

a syringe-handling magazine adapted to receive and hold a plurality of syringes while each such syringe is connected to a selected one of said syringe filling tubes, said magazine being operative to deliver each syringe after such syringe has been filled with a predetermined volume and concentration of said injectate solution;

pumping apparatus for propelling said solution and said diluent from said solution and diluent containers, through said mixing apparatus, through said injectate delivery conduit, through said flow directing means, and through said syringe delivery tubes and into said syringes; and, a programmable controller in communication with said mixing apparatus, said flow directing apparatus, said pumping apparatus and said syringe delivery magazine;

said controller being capable of receiving operator input of the i) desired number of syringes to be filled, ii) the desired volume of injectate solution to be dispensed into each syringe, and iii) the desired concentration of injectate solution to be dispensed into each syringe;

said controller being further operative to send control signals to i) said mixing apparatus, ii) said pumping apparatus, iii) said flow directing apparatus, and iv) said syringe handling magazine, to cause the desired number of syringe(s) to be filled with the desired volume(s) and the desired concentration(s) of injectate solution as input by the operator;

b) programming the controller by inputting the desired number of syringes to be filled, the desired volume of injectate solution to be dispensed into each syringe, and the desired concentration of injectate solution to be dispensed into each syringe;

c) causing control signals to be sent by said controller to said mixing apparatus, said pumping apparatus, said flow directing apparatus and said syringe handling magazine, to thereby fill the desired number of syringe (s) with the desired volume(s) and the desired concentration(s) of injectate solution.

19. The method of claim 18 further comprising the additional step of:

d) causing each receiving syringe to be disconnected from its syringe filling tube after it has been filled with the desired volume and the desired concentration of injectate solution.

20. A method for filling one or more receiving syringes with desired volume(s) and desired concentration(s) of an injectate solution, said method comprising the steps of:

a) providing a syringe filling device which comprises:

i) at least one solution container containing a solution at a first concentration;

ii) at least one diluent container containing a diluent which is suitable for diluting said solution;

iii) a mixing apparatus fluidly connected to said solution container and said diluent container, said mixing apparatus being operative to combine a predetermined amount of said solution with a predetermined amount of said diluent to form an injectate solution of a predetermined volume and concentration;

iv) an injectate delivery conduit attached to said mixing apparatus, for delivering said injectate solution of said predetermined volume and concentration;

v) a receiving syringe having a barrel and a plunger movably disposed within the barrel, said receiving syringe being connected to said injectate delivery conduit such that when the when the plunger of the syringe is withdrawn in a first direction, injectate will be thereby drawn through the delivery conduit and into the barrel of the receiving syringe;

vi) a syringe pump engageable with said receiving syringe and operative to withdraw the plunger of the receiving syringe to cause the desired volume of injectate solution to be drawn into the barrel of the receiving syringe;

a programmable controller in communication with at least said mixing apparatus, and said syringe pump;

said controller being capable of receiving operator input of i) the desired volume of injectate solution to be dispensed into each receiving syringe, and iii) the desired concentration of injectate solution to be dispensed into each receiving syringe;

said controller being further operative to send control signals to said mixing apparatus and said syringe pump to cause the syringe to be filled with the desired volume and the desired concentration of injectate solution;

b) programming the controller by inputting the desired volume of injectate solution to be dispensed into each receiving syringe and the desired concentration of injectate solution to be dispensed into each receiving syringe;

c) causing the controller to send control signals to said mixing apparatus and to said syringe pump to cause each syringe to be filled with the desired volume and the desired concentration of injectate solution.

21. The method of claim 20 further comprising the additional step of:

d) causing each syringe to be disconnected from the device provided in step a, after that syringe has been filled with the desired volume and the desired concentration of injectate solution.

22. The method of claim 20 adapted for filling a desired number of syringes with desired concentration(s) and desired volume(s) of said injectate solution, wherein the syringe filling device provided in step a further comprises:

vii) a flow directing apparatus connected to said injectate delivery conduit, said flow directing apparatus having a plurality of outlets formed therein and means for selectively channeling the flow of injectate from the injectate delivery conduit, out of a selected one of the outlet openings formed in said flow directing apparatus;

viii) a syringe handling magazine adapted to receive a plurality of said receiving syringes with each of said receiving syringes being connected to a selected one of the outlet openings of the flow directing apparatus, said magazine being operative to serially dispense a desired number of the syringes after they have been filled with the desired concentration and the desired volume of injectate;

and wherein said programmable controller is further in communication with said flow directing apparatus and said syringe handling magazine, said controller being further capable of receiving operator input of the desired number of receiving syringes in addition to the desired concentration and volume of injectate to be dispensed into each receiving syringe;

said controller being further operative to send control signals to said flow directing apparatus and said syringe magazine to fill the desired number of syringes with the desired volume and concentration of injectate, and to dispense said desired number of syringes to the operator;

and wherein step b of the method further comprises programming the controller by inputting the desired number of syringes to be filled and the desired volume and concentration of injectate solution to be placed in each such syringe;

and wherein step c of the method further comprises causing the controller to send control signals to said flow directing apparatus and said syringe handling magazine to fill the desired number of syringes with the desired volumes and concentrations of said injectate solution.

* * * * *